US006497953B1

(12) United States Patent
Yu et al.

(10) Patent No.: US 6,497,953 B1
(45) Date of Patent: Dec. 24, 2002

(54) POLYMERIC FIBERS AND SPINNING PROCESSES FOR MAKING SAID POLYMERIC FIBERS

(75) Inventors: Michael Yu, Chelmsford, MA (US); Eduardo Romero, Brookline, NH (US); Curtis E. Adams, Watertown, MA (US); Marinus A. Potter, The Hague (NL); James A. Belmont, Acton, MA (US); Patrick Collins, Andover, MA (US)

(73) Assignee: Cabot Corporation, Boston, MA (US)

( * ) Notice: Subject to any disclaimer, the term of this patent is extended or adjusted under 35 U.S.C. 154(b) by 0 days.

(21) Appl. No.: 09/168,882

(22) Filed: Oct. 9, 1998

(51) Int. Cl.[7] ..... D02G 3/00

(52) U.S. Cl. ..... 428/372; 428/364; 428/394; 428/395

(58) Field of Search ..... 428/364, 372

(56) References Cited

U.S. PATENT DOCUMENTS

| | | | | |
|---|---|---|---|---|
| 1,955,825 A | | 4/1934 | Palmer | 18/54 |
| 2,072,858 A | | 3/1937 | Holland | 8/5 |
| 2,514,236 A | | 7/1950 | Glassman | 106/289 |
| 2,941,970 A | | 6/1960 | Craig | 260/29.6 |
| 3,007,891 A | | 11/1961 | Gerstenberg et al. | 260/40 |
| 3,007,892 A | | 11/1961 | Gruschke et al. | 260/40 |
| 3,117,943 A | | 1/1964 | Corbiere et al. | 260/41 |
| T871,008 I4 | | 2/1970 | McSpadden, Jr. | 260/22 |
| 4,048,139 A | | 9/1977 | Calundann et al. | 260/45.8 N |
| 4,087,494 A | * | 5/1978 | Reinehr et al. | 264/78 |
| 4,879,335 A | | 11/1989 | Hirota et al. | 524/495 |
| 5,200,164 A | * | 4/1993 | Medalia et al. | 423/265 |
| 5,223,196 A | | 6/1993 | Shridharani et al. | 264/78 |
| 5,391,703 A | | 2/1995 | Lin | 528/339 |
| 5,459,195 A | | 10/1995 | Longhi | 524/538 |
| 5,747,563 A | | 5/1998 | Flenniken et al. | 523/215 |
| 5,800,746 A | | 9/1998 | Jones et al. | 264/13 |
| 5,837,045 A | * | 11/1998 | Johnson et al. | 106/413 |
| 5,900,029 A | * | 5/1999 | Belmont et al. | 8/550 |
| 5,916,934 A | * | 6/1999 | Mahmud et al. | 523/215 |

FOREIGN PATENT DOCUMENTS

| | | | |
|---|---|---|---|
| EP | 0 356 579 A2 | 3/1990 | D01F/1/04 |
| GB | 1116207 | 6/1968 | B01F/17/22 |
| JP | 54-067424 | 12/1980 | D01F/8/08 |
| JP | 54-080573 | 1/1981 | D01F/6/54 |
| JP | 54-084287 | 1/1981 | D01F/8/04 |
| JP | 54-075643 | 6/1981 | D01F/8/04 |
| JP | 62-003720 | 7/1988 | C09D/5/00 |
| JP | 62-138248 | 12/1988 | C09C/1/56 |
| JP | 62138248 | 12/1988 | D01F/2/14 |
| JP | 62-157498 | 1/1989 | D01F/6/90 |
| JP | 01-006113 | 2/1989 | D01F/2/14 |
| JP | 62288533 | 5/1989 | G02B/6/00 |
| JP | 01-139813 | 6/1989 | D01F/6/90 |
| JP | 01-139814 | 6/1989 | D01F/6/90 |
| JP | 01-234676 | 9/1989 | F16K/47/02 |
| JP | 01-171730 | 2/1991 | C08L/9/00 |
| JP | 01235622 | 5/1991 | D01F/6/56 |
| JP | 07-216639 | 8/1995 | D01F/6/54 |
| WO | 92/13983 | 8/1992 | C25D/11/00 |
| WO | WO 96/18688 | 6/1996 | |
| WO | 96/18688 | 6/1996 | C09C/1/56 |
| WO | WO 97/48769 | 12/1997 | |

* cited by examiner

*Primary Examiner*—Cynthia H. Kelly
*Assistant Examiner*—J. M. Gray

(57) ABSTRACT

Methods of making polymeric fibers are provided and include spinning a solution containing at least one polymer, a modified pigment having attached at least one organic group, and a solvent. The polarity of the solvent and the polarity of the modified pigment are selected such that the polymer is soluble in the solution and the modified pigment is maintained dispersed throughout the solution. The polarity of the modified pigment may be substantially the same as the polarity of the solvent. Fibers of acrylic-containing polymers and other polymeric fibers are also provided. Articles and reinforcing material containing the various fiber(s) are also described.

41 Claims, 4 Drawing Sheets

POLYMERIC FIBERS AND SPINNING PROCESSES FOR MAKING SAID POLYMERIC FIBERS

FIELD OF THE INVENTION

The present invention relates to spinning processes for forming polymeric fibers. The present invention also relates to colored polymeric fibers.

BACKGROUND OF THE INVENTION

Acrylic and acrylic-containing polymeric fibers and other polymeric fibers are often colored with pigments to form colored fabrics. The ability of the fiber to retain the color of the pigment depends in part on the degree of incorporation of the pigment into the structure of the fiber. Wet and dry spinning are methods of forming acrylic and acrylic-containing polymeric fibers. In such methods, a poorly dispersed pigment in the spinning solution can produce fibers having poorly incorporated pigment. Without good dispersion of the pigment in the spinning solution, the pigment can plug up the filter screen and spinneret holes, and the fibers spun from the solution can break easily and exhibit poor color strength and color retention. Pigments that are not substantially compatible with a spinning solution can form non-stable dispersions, agglomerate, and/or clump together in the solution. Although mechanical mixing can be used to disperse a pigment in a spinning solution, the pigment will generally settle out of the solution and/or agglomerate if the pigment is not substantially compatible with the solution.

Thus, there is still a need for pigmented polymeric fibers which exhibit good, if not, excellent color retention and uniformity. There is also a need for a solution for spinning polymeric fibers, wherein the solution includes a pigment that can remain highly dispersed throughout the solution and become substantially incorporated into a fiber made from the solution. There is also a need for a spinning method for making polymeric fibers exhibiting uniform pigment distribution throughout the fibers, and high jetness when the pigment is a black pigment, like carbon black.

SUMMARY OF THE INVENTION

The present invention provides polymeric fibers which preferably exhibit uniformity of color throughout the fibers and have uniform weather and light-resistant color. The present invention also provides a solution for spinning polymeric fibers, wherein the solution includes a polymer and at least one pigment that remains highly or substantially dispersed throughout the solution, preferably over a period of one day or longer. The present invention also provides a polymeric fiber having a pigment which is substantially uniformly and homogeneously dispersed throughout the fiber. The present invention also provides spinning methods for making polymeric fibers. The fibers preferably exhibit a uniformly dispersed pigment distribution throughout the fibers.

The present invention relates in part to a method of making a polymeric fiber having incorporated therein a modified pigment, for example, a modified carbon black. The modified pigment has at least one organic group attached thereto. The attached organic group preferably provides the pigment with a polarity that enables the pigment to be highly dispersed in a spinning solution. Preferably, the polarity of the modified pigment is compatible with the polarity of the solvent such that the modified pigment can become highly or substantially dispersed in the spinning solution when combined together, and such that the modified pigment remains dispersed throughout the spinning solution, preferably for a period of time, for example, for 24 hours or more.

Preferred organic groups attached to the pigments for use in the present invention include groups containing a) at least one aromatic group or a $C_1$–$C_{12}$ alkyl group, optionally with b) at least one ionic group, at least one ionizable group, or a mixture of an ionic group and an ionizable group.

According to the present invention, methods are provided which include forming a spinning solution of at least one polymer, at least one modified pigment having at least one organic group attached thereto, and a solvent. The solvent substantially maintains the polymer in a dissolved state. The modified pigment preferably remains highly or substantially dispersed throughout the spinning solution.

Herein, the term "acrylic-containing polymer" refers to polymers formed from monomeric reactants including at least one monomeric acrylic structural unit. The acrylic-containing polymer may be a polyacrylic homopolymer containing repeating units of reacted acrylic monomers, or the polymer may be a polyacrylonitrile copolymer containing units of acrylonitrile monomers and units of polymerizable olefinic monomers. These acrylic-containing polymers also include "acrylic" and "modacrylic fibers" as these terms are understood in the art. Other acrylic-containing homopolymers, copolymers, terpolymers, and oligomers may also be used according to the present invention so long as each contains at least one acrylic structural unit in the polymer.

According to the present invention, the polarity of the solvent used in the spinning solution and the polarity of the modified pigment are such that the modified pigment is maintained substantially dispersed throughout the solvent. In addition, as mentioned above, the solvent is capable of substantially maintaining the polymer in a dissolved state under the conditions used for spinning. Preferably, the polarity of the modified pigment is compatible with, or substantially close to or the same as, the polarity of the solvent used for dissolving the polymer.

BRIEF DESCRIPTION OF THE DRAWINGS

The present invention may be more fully understood with reference to the accompanying drawings which are intended to illustrate, not limit, the invention.

DETAILED DESCRIPTION OF THE INVENTION

Figure 1:
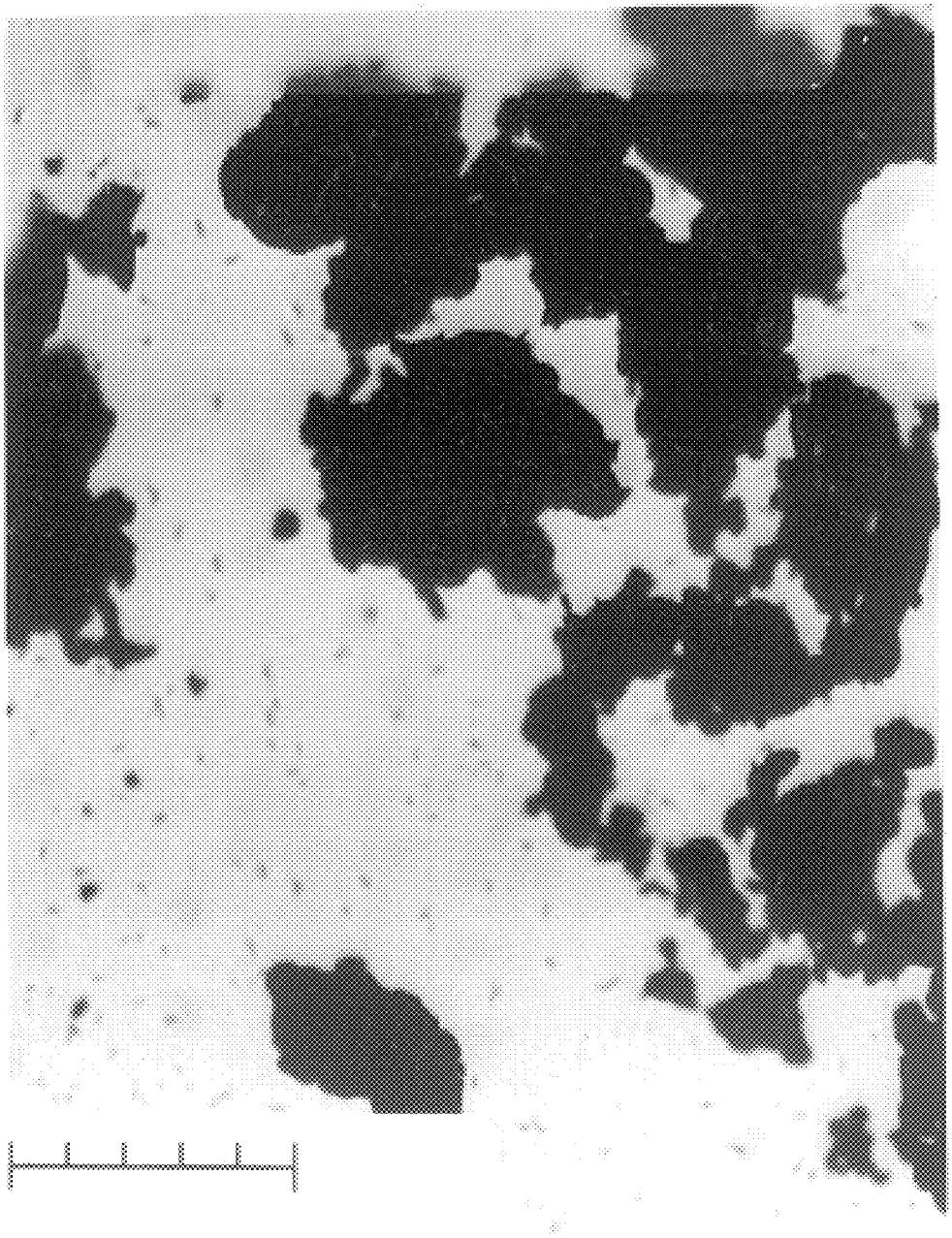
FIG. 1 is a photomicrograph of a spinning solution comprising unmodified carbon black which has agglomerated together.

The present invention relates to polymeric fibers containing modified pigments. The present invention also relates to methods of making polymeric fibers having incorporated therein a modified pigment. Spinning methods are described, for example, in Kirk and Othmer's *Encyclopedia of Science,* 3rd Edition, Volume 10, pages 172–177 (1978), incorporated in its entirety by reference herein. Spinning processes are also disclosed in the *Encyclopedia of Polymer Science and*

*Engineering,* Marks et al., 2d Edition, at pages 361–363, which is also incorporated in its entirety herein by reference. For purposes of the present invention, the spinning methods are preferably those spinning methods involving a spinning solution, such as wet spinning and dry spinning. In the following discussion, acrylic fibers are used for example purposes only, and other polymeric fibers can be made according to the present invention. In a typical wet spinning process, a spinning solution, or dope, is formed from an acrylic-containing polymer or polymer precursor composition, such as a composition comprising an acrylonitrile monomer, a comonomer, and a catalyst. The solution contains a dissolved acrylic-containing polymer in a solvent which may be prepared by combining a pre-formed polymer with a solvent, or which may be formed by in situ polymerization of the monomers in the solution. The wet spinning solution with dissolved polymer therein is pumped through spinnerets into a coagulation bath, herein referred to as a fiber-forming bath in which the fibers are coagulated and wet spinning solution solvent is removed. Filaments or fibers are formed from the dissolved polymer as the solution leaves the spinnerets and enters the bath. At the exit of the bath, additives may be applied to the fibers and the fibers are collected in bundles of the desired tex or denier. The collected fibers may be drawn or oriented. The fibers are then finished, crimped and dried. Drying can comprise collapsing and relaxing the fiber structure. Finally, the fibers are subjected to tow and cut operations. In a dry spinning operation, the same steps are taken as in wet spinning except the fiber is not formed and the solvent is not removed by a coagulation bath, but the fiber is formed and the solvent removed by dry means, such as by evaporation in a stream of air or an inert gas.

Pigments can be added to the spinning solution if colored fibers are desired. It has been found, however, that pigments, including carbon blacks, often do not disperse readily in spinning solutions, and thus such solutions may not provide fibers that exhibit satisfactory color retention and/or uniform color distribution. According to the present invention, however, colored fibers are produced, for instance, from spinning processes using modified pigments that preferably do not leach out of the fibers and that exhibit excellent color uniformity and/or color retention.

In order to provide such desired properties in a produced fiber, the present invention uses a modified pigment that is dispersible throughout a spinning solution used to form the fiber, and which preferably has a high surface area. By well dispersed, it is meant that the modified pigment particles are substantially, homogeneously distributed throughout the solution. Preferably, the modified pigment does not fall out of, or settle to the bottom of, the solution even after periods of 24 hours or longer. Highly dispersed pigments in spinning solutions and fibers can lead to weather-resistant, washing-resistant, light-resistant color, and/or uniform color distribution throughout the fiber, and can lead to high jetness when a modified black pigment is used, such as modified carbon black.

The modified pigment has at least one organic group attached thereto. Generally, the organic group is any group which permits the pigment to be more dispersible in a spinning solution. The attached organic group preferably includes a) at least one aromatic group or a $C_1$–$C_{12}$ alkyl group and optionally with b) at least one ionic group, at least one ionizable group, or a mixture of an ionic group and an ionizable group. Preferably, the aromatic group or the $C_1$–$C_{12}$ alkyl group of the organic group is directly attached to the pigment.

Sodium sulfophenyl and sodium carboxyphenyl are preferred organic groups attached to a pigment to form the modified pigment useful in the present invention. Other useful organic groups are also described in the published International Patent Applications WO 97/47699, WO 97/47692, WO 97/47698, WO 9618688, and U.S. Pat. Nos. 5,554,739; 5,630,868; 5,698,016; 5,707,432, and U.S. patent application Ser. Nos. 08/990,715, pending and 08/909,944, now U.S. Pat. No. 5,895,522, all incorporated in their entirety by reference herein. For example, preferred pigments useful in the present invention include pigments having attached an organic group having the formula —Ar—$R^1$ (I) or —Ar'—$R^3R^2$ (II) wherein Ar and Ar' are aromatic groups. In formula (I) above, Ar is substituted with at least one $R^1$ group which is an aromatic or aliphatic group containing a hydrophobic group and at least one hydrophilic group. In formula (II) above, Ar' is substituted with at least one $R^2$ group and at least one $R^3$ group, wherein $R^2$ is a hydrophilic group, and $R^3$ is an aromatic or aliphatic group containing a hydrophobic group. The organic group can also comprise a) an aromatic group or a $C_1$–$C_{12}$ alkyl group and b) an ionic or ionizable group, wherein the organic group has the formula: —AG—Sp—LG—Z, wherein AG is an activating group, Sp is a spacer group that assists the activating group to promote elimination of the leaving group, LG. LG is a leaving group, and Z is a counterion. The activating group is any group that promotes elimination of the leaving group. Examples of activating groups include, but are not limited to, —$SO_2$—, —$NRSO_2$—, —NRCO—, —$O_2C$—, —$SO_2NR$ and the like. R is independently hydrogen, $C_1$–$C_{12}$ substituted or unsubstituted alkyl, $C_2$–$C_{12}$ substituted or unsubstituted alkenyl, cyanoethyl, or a substituted or unsubstituted $C_7$–$C_{20}$ aralkyl or alkaryl. The spacer group is preferably any ethylene group or a substituted ethylene group with at least one hydrogen on the carbon which is adjacent to —AG. The leaving group is any group that may be eliminated from the organic group which is attached to the pigment. After the leaving group is eliminated from the organic group attached to the pigment product, the number of ionic or ionizable groups remaining attached to the pigment product is reduced. Examples of leaving groups include, but are not limited to, —$OSO_3^-$, —$SSO_3^-$, —$OPO_3^{2-}$, $Q^+$, and the like. $Q^+$is $NR_3^+$, $N(C_2H_4)_3N^+$, or a N-substituted heterocycle, such as pyridinium. The aromatic group or $C_1$–$C_{12}$ alkyl group is directly attached to the pigment and there are no limits on the amount of organic group present on the pigment. Suitable ionic or ionizable groups of the formula AG—Sp—LG—Z include, but are not limited to, $SO_2C_2H_4OSO_3^-M^+$, $SO_2C_2H_4SSO_3^-M^+$, $SO_2C_2H_4OPO_3^{2-}(M^+)_2$, $SO_2C_2H_4Q^+X^-$, $NRSO_2C_2H_4OSO_3^-M^+$, $NRSO_2C_2H_4SSO_3^-$, $M^+$, $NRSO_2C_2H_4OPO_3^{2-}(M^+)_2$, $NRSO_2C_2H_4Q^+X^-$, $SO_2NRC_2H_4OSO_3^-M^+$, $SO_2NRC_2H_4SSO_3^-M^+$, $SO_2NRC_2H_4OPO_3^{2-}(M^+)_2$, $SO_2NRC_2H_4Q^+X^-$, $NRCOC_2H_4OSO_3^-M^+$, $NRCOC_2H_4SSO_3^-M^+$, $NRCOC_2H_4Q^+X^-$, $O_2CC_2H_4OSO_3^-M^+$, $O_2CC_2H_4SSO_3^-M^+$, $SO_2C_2H_4SO_2C_6H_4SO_3^-M^+$, $SO_2C_2H_4SO_2C_6H_4CO_2^-M^+$, $NRCOC_2H_4SO_2C_2H_4OSO_3^-M^+$, $NRCOC_2H_4SO_2C_6H_4SO_3^-M^+$, $NRCOC_2H_4SO_2C_6H_4CO_2^-M^+$, wherein R is independently hydrogen, $C_1$–$C_{12}$ substituted or unsubstituted alkyl, $C_2$–$C_{12}$ substituted or unsubstituted alkenyl, cyanoethyl, or a $C_7$–$C_{20}$ substituted or unsubstituted aralkyl or alkaryl; M is H, or an alkali metal ion, e.g., Li, Na, K, Cs, or Rb, and Q is as defined above. X is a halide or an anion derived from a mineral or organic acid. A preferred organic group is $C_6H_4SO_2C_2H_4OSO_3^-Na^+$.

In general, the organic group is preferably present at a treatment level of from about 0.10 micromoles/$m^2$ ($\mu$mol/$m^2$) to about 6.0 $\mu$mol/$m^2$ of the pigment used based on the nitrogen surface area of the pigment, more preferably at a treatment level of from about 1.0 $\mu$mol/$m^2$ to about 4.0 $\mu$mol/$m^2$.

Pigment, as used herein, is any pigment which can be modified with the attachment of at least one organic group. Examples include, but are not limited to, carbon products and pigments other than carbon products. Preferably, the pigments other than the carbon products have no primary amines, and preferably, have at least one aromatic ring in its repeating structure or at its surface to promote the modification of the organic group to the surface of the pigment. The pigment can be black, blue, brown, cyan, green, violet, magenta, red, yellow, as well as mixtures thereof. Suitable classes of pigments include, for example, anthraquinones, phthalocyanine blues, phthalocyanine greens, diazos, monoazos, pyranthrones, perylenes, heterocyclic yellows, quinacridones, and (thio)indigoids. Representative examples of phthalocyanine blues include copper phthalocyanine blue and derivatives thereof (Pigment Blue 15). Representative examples of quinacridones include Pigment Orange 48, Pigment Orange 49, Pigment Red 122, Pigment Red 192, Pigment Red 202, Pigment Red 206, Pigment Red 207, Pigment Red 209, Pigment Violet 19 and Pigment Violet 42. Representative examples of anthraquinones include Pigment Red 43, Pigment Red 194 (Perinone Red), Pigment Red 216 (Brominated Pyranthrone Red) and Pigment Red 226 (Pyranthrone Red). Representative examples of perylenes include Pigment Red 123 (Vermilion), Pigment Red 149 (Scarlet), Pigment Red 179 (Maroon), Pigment Red 190 (Red), Pigment Violet, Pigment Red 189 (Yellow Shade Red) and Pigment Red 224. Representative examples of thioindigoids include Pigment Red 86, Pigment Red 87, Pigment Red 88, Pigment Red 181, Pigment Red 198, Pigment Violet 36, and Pigment Violet 38. Representative examples of heterocyclic yellow include Pigment Yellow 117 and Pigment Yellow 138. Examples of other suitable colored pigments are described in Colour Index, 3d edition (The Society of Dyers and Cikiyrusts, 1982), incorporated herein in its entirety by reference.

Carbon products, as used herein, may be of the crystalline or amorphous type. Examples include, but are not limited to, graphite, carbon black, carbon fiber, vitreous carbon, activated charcoal, and activated carbon.

Finely divided forms of the above are preferred. Also, it is possible to utilize mixtures of different pigments including mixtures of different carbon products and/or different carbon blacks. A preferred pigment is a high surface area carbon black, for example, carbon black having a surface area of about 150 $m^2$/g or more. In general, high surface area pigments are preferred, since such pigments generally lead to a more consistent, uniform tone of color, and when high surface area black pigments are used, a higher jetness can be achieved. The present invention permits the use of such higher surface area pigments in the form of high surface area modified pigments, since traditionally, high surface area pigments have been difficult to disperse in spinning solutions until now.

With respect to introducing the modified pigment to the spinning solution, any manner of introduction can be used. The modified pigment can be added in dry form directly into the spinning solution or as a slurry. Also, the modified pigment may first be dispersed in a solvent to form a mother liquor before being combined with the acrylic-containing polymer and the solvent of the spinning solution. If the pigment is supplied in the form of a mother liquor, the solvent used in the mother liquor is preferably capable of forming a dispersion and maintaining the pigment in a highly dispersed state. Preferably, the mother liquor is a dispersion wherein the pigment does not settle to the bottom of the liquor after a substantial period of time, for example, after three days. If the pigment is supplied in the form of a mother liquor, the solvent used in the mother liquor is preferably compatible, and more preferably, miscible, with the solvent used in the wet spinning solution. A preferred room temperature viscosity for a mother liquor is from about 50 centipoise (cP) to about 500 cP, for example, about 100 cP.

If the pigment is supplied in the form of a mother liquor, the mother liquor may also include a dispersant, for example, from about 0.1% by weight to about 1.0% by weight monoethanolamine. The mother liquor can also include a thickener such as from about 1.0% by weight to about 5.0% by weight polymer, preferably the same polymer as is used in the spinning solution to form fibers.

According to the present invention, methods are provided which include forming a spinning solution of at least one acrylic-containing polymer, a modified pigment having at least one organic group attached thereto, and a solvent in which the polymer is soluble and the pigment can be maintained in a dispersed state under spinning conditions. In forming the spinning solution, the various components can be added in any order. Preferably, the modified pigment is introduced once all other components are present in the spinning solution. The solvent should maintain the acrylic-containing polymer in a dissolved state, and may include conventional spinning solution solvents. The spinning solution solvent may include a polar solvent, such as an organic polar solvent. Exemplary solvents that may be used in the spinning solutions or formulations of the present invention include dimethyl formamide, dimethyl acetamide, dimethyl sulfoxide (DMSO), ethylene carbonate, aqueous solutions of sodium thiocyanate (NaSCN) having preferred NaSCN concentrations of from about 45% by weight to about 55% by weight, aqueous solutions of nitric acid ($HNO_3$) having preferred $HNO_3$ concentrations of from about 65% to about 75% by weight, aqueous solutions of zinc chloride ($ZnCl_2$) having preferred $ZnCl_2$ concentrations of from about 55% by weight to about 65% by weight, and any combinations thereof Preferred solvents include those that comprise or contain dimethyl formamide (DMF).

When an organic solvent is used to dissolve the polymer, the same solvent is preferably used to form the mother liquor containing the pigment. When an aqueous solution of NaSCN, $HNO_3$, or $ZnCl_2$ is used to dissolve the polymer, a dilute solution or water is preferably used to form the mother liquor containing the pigment.

According to the present invention, the polarity of the solvent used in the spinning solution and the polarity of the modified pigment are compatible such that the modified pigment is substantially dispersed throughout the solvent. In addition, as mentioned above, the solvent is capable of maintaining the acrylic-containing polymer in a dissolved state under the conditions used for spinning. Preferably, the polarity of the modified pigment is compatible with, and more preferably, substantially relatively the same as, the polarity of the solvent used for dissolving the acrylic-containing polymer.

The spinning solution is preferably maintained at a temperature of from about 60° C. to about 90° C., more preferably about 70° C., during the spinning process. The viscosity of the spinning solution is preferably from about 400 cP to about 500 cP at 50° C.

The acrylic-containing polymer contains the reaction product of monomeric reactants which comprise or include at least one monomeric acrylic structural unit. The acrylic-containing polymer may be a homopolymer containing repeating units of reacted acrylic monomers, or the polymer may be a copolymer of acrylic structural units and structural units of another monomeric reactant. An exemplary copolymer which may be used to form the fibers of the present invention is a polyacrylonitrile copolymer containing units of acrylonitrile monomers and units of polymerizable olefinic monomers. A preferred copolymer is a polyacrylonitrile copolymer containing acrylonitrile structural units and structural units of other polymerizable or polymerized olefinic monomers. In cases wherein the polymer is a copolymer such as a polyacrylonitrile (PAN) copolymer, the copolymer may have alternating units of reacted acrylic monomers and reacted comonomers, or the copolymer may contain randomly ordered units of reacted acrylic monomer and reacted comonomers. Other acrylic-containing homopolymers, copolymers, terpolymers and oligomers may also be used according to the present invention so long as each contains at least one acrylic structural unit in the polymer.

According to the present invention, the acrylic-containing polymer may comprise a composition of acrylonitrile, neutral comonomer, and optionally an acid comonomer. Conventional acrylonitrile polymer compositions may be used. Exemplary compositions include those containing at least about 85% by weight acrylonitrile monomer. Preferred compositions include those containing from about 90% by weight to about 94% by weight acrylonitrile, from about 6% by weight to about 9% by weight neutral comonomer, for example, methyl acrylate, vinyl acetate and/or methyl methacrylate, and optionally up to about 1% by weight acid comonomer, such as sodium styrene sulfonate, sodium methallyl sulfonate, sodium sulfophenyl methallyl ether, and/or itaconic acid. Spinning solutions of modacrylic, or flame retardant, fiber precursors can be used according to the present invention and include compositions having acrylonitrile monomer and at least about 15% by weight comonomer. Preferred modacrylic compositions include those containing less than or equal to about 66% by weight acrylonitrile, from about 34% by weight to about 51% by weight halogen comonomer such as vinyl chloride, vinylidene chloride, and/or vinyl bromide, and optionally up to about 5% by weight of a minor comonomer selected from sulfonate comonomers and acrylamide comonomers.

Conventional spinning solution catalysts may be employed, if necessary, in effective amounts to catalyze the polymerization of monomeric components in the spinning solution.

The acrylic-containing polymer is preferably formed at any time before exiting the spinneret into the fiber-forming bath. The polymer may be formed before dissolution in the solvent, or it may be formed in situ in the spinning solution.

The concentration of polymer in the spinning solution is preferably from about 5% by weight to about 40% by weight based on the weight of the solution. When the solution comprises an aqueous solution of sodium thiocyanate, the concentration of acrylic-containing polymer in the solution is preferably from about 5% by weight to about 25% by weight, more preferably from about 10% by weight to about 15% by weight. When the solution comprises an aqueous solution of nitric acid, the concentration of acrylic-containing polymer in the solution is preferably from about 5% by weight to about 20% by weight, more preferably from about 8% by weight to about 12% by weight. When the solution comprises an aqueous solution of zinc chloride, the concentration of acrylic-containing polymer in the solution is preferably from about 5% by weight to about 20% by weight, more preferably from about 8% by weight to about 12% by weight. When the solution comprises an aqueous solution of ethylene carbonate, the concentration of acrylic-containing polymer in the solution is preferably from about 10% by weight to about 40% by weight, more preferably from about 15% by weight to about 18% by weight. When the solution comprises DMSO, the concentration of acrylic-containing polymer in the solution is preferably from about 10% by weight to about 40% by weight, more preferably from about 20% by weight to about 25% by weight.

The fiber-forming bath when the spinning, process used is wet spinning, which can also be referred to as a coagulation bath, can comprise any conventional coagulation bath medium. Preferably, the fiber-forming bath comprises a water/solvent mixture or solution that promotes the formation of fiber filaments from the spinning solution as the solution is pumped through the spinnerets. According to the present invention, the fiber-forming bath preferably comprises an aqueous solution of the spinning solution solvent. For example, a preferred fiber-forming bath comprises a 40:60 weight ratio of DMF to water. Other exemplary fiber-forming baths may contain from about 20% by weight to about 60% by weight DMF and from about 40% to about 80% by weight water. Other fiber-forming baths that may be used in connection with the present invention include baths comprising from about 20% by weight to about 60% by weight dimethyl acetamide and from about 40% by weight to about 80% by weight water, for example, a dimethyl acetamide to water weight ratio of about 40:60. Water can be metered into the fiber-forming bath to maintain a constant bath composition.

The temperature of the fiber-forming bath is preferably kept within the range of from about 20° C. to about 80° C., preferably from about 30° C to about 50° C., more preferably about 45° C., depending upon a number of factors including the polymeric component(s) and solvent(s) of the spinning solution.

Besides the above-describedfibers, other fibers can be used in lieu of acrylic fibers. For instance, a fiber comprising cellulose can be used. Examples include, but are not limited to rayons, including, viscose rayon, and other modifications of rayon.

Another embodiment of the present invention are fibers comprising a long-chain synthetic polyamide, where preferably at least 85% of the amide (—CO—NH—) linkages[]area attached directly between two aromatic rings. Examples include, but are not limited to, NOMEX and KEVLAR. KEVLAR is a polyamide where all of the amide groups are separated by para-phenylene groups. NOMEX has meta-phenylene groups wherein the amide groups are attached to the phenyl ring at the 1 and 3 positions.

An additional embodiment of the present invention are fibers comprising a long-chain synthetic polymer comprised of at least 85% of a segmented polyurethane. Examples include, but are not limited to, Spandex fiber.

A further fiber comprises cellulose acetate, such as diacetate fibers and triacetate fibers (e.g, where about not less than 92% of the hydroxyl groups are acetylated).

Another fiber comprises a long-chain aromatic polymer having recurring imidazole groups as an integral part of the polymer chain. Examples include, but are not limited to, polybenzimidazole (PBI).

A final example of a fiber that forms part of the present invention is a fiber comprising a long-chain synthetic polymer comprising vinyl chloride units $(—CH_2CHCl—)_x$, preferably at least 85% by weight vinyl chloride units. Examples include, but are not limited to, vinyon fiber.

These other fibers can be prepared in a similar manner as acrylic fiber, using, for instance, a spinning process. The modified pigments can be incorporated into the spinning solution for these various fibers in the same manner. The solvent(s) present in the spinning solution for each of the fibers are conventional and known to those skilled in the art.

When the fiber is formed from the spinning operation, an advantage of the present invention is the retention of the modified pigment on and/or within the fiber. In other words, the modified pigment does not separate from the fiber when the polymer is exiting the spinneret in the form of a fiber. The modified pigment is embedded or trapped by the polymer comprising the fiber. This property of pigment retention is especially advantageous when a wet spinning process is used since the coagulation bath or fiber-forming bath is used to remove substantially, if not all of the solvent, present with the polymer when exiting the spinneret. It was surprising to discover that the modified pigment did not substantially leach into or disperse into the fiber-forming bath but remained essentially, if not entirely, dispersed with the polymeric fiber. Accordingly, this advantage of pigment retention in the fiber without substantial pigment release in the fiber-forming bath is an advantage of the present invention.

The fibers can be in any shape and/or thickness permitted by the spinneret design. Shapes include, but are not limited to, hollow fibers, solid rounded fibers, solid square or rectangular fibers, or other geometrical designs. Thicknesses of fiber, include, but are not limited to from about 0.5 to about 20 denier per filament (8 to 49 $\mu$m in diameter per filament).

The fibers of the present invention are useful in a variety of goods including, but not limited to, apparel, home furnishings, feminine care products, diapers, woven and non-woven goods, and industrial and other uses. Acrylic apparel which may be made from the fibers of the present invention include sweaters, socks, fleece, circular knit apparel, sportswear, children's wear, and the like. Home furnishings which may benefit from the fibers of the present invention include, blankets, rugs, upholstery, pile, luggage, awnings, furniture, and the like. Industrial uses of the fibers of the present invention can include asbestos replacement, concrete reinforcing structures, stucco reinforcing structures, and the like. Other uses of the fibers of the present invention include, but are not limited to, craft yarns, sail cover cloths, wipe cloths, and the like. The fibers of the present invention can be used to form a part of any one of these goods where polymeric fibers are conventionally used.

The present invention will be further exemplified by reference to the following examples, which are intended to illustrate, not limit, the present invention.

EXAMPLES

In the Examples below, a variety of carbon blacks and carbon blacks having attached organic groups were used to illustrate the present invention. Some of the carbon blacks used in the Examples and Comparative Example are listed in Table 1 below.

TABLE 1

| Property | Carbon Black | | |
|---|---|---|---|
| | BLACK PEARLS ® 450 | Elftex ® TP | CB-1 |
| Surface Area $m^2/g$ | 82 | 86 | 348 |
| dibutyl phthalate (DBP) absorption (ml/100 g) | 72 | 99 | 105 |

The surface areas reported in Table 1 were determined according to CTAB surface area using ASTM D-3765. The DBP absorption values reported in Table 1 were determined according to ASTM D-2414.

CB-2, CB-3, and CB-4 were prepared by charging CB-1, sulfanilic acid, and sodium nitrite solution into a continuously operating pin mixer using the quantities in Table 2, below. The resulting materials were dried to give a carbon black product having attached $p\text{-}C_6H_4SO_3Na$ group.

TABLE 2

| | carbon black (CB-1) feed rate (parts/hr) | sulfanilic acid feed rate (parts/hr) | sodium nitrate solution feed rate (parts/hr) | sodium nitrite solution concentration |
|---|---|---|---|---|
| CB-2 | 50 | 4.5 | 60.0 | 3.14 wt % |
| CB-3 | 50 | 7.5 | 51.0 | 6.15 wt % |
| CB-4 | 45.4 | 8.63 | 47.7 | 7.55 wt % |

CB-5 was prepared by treating fluffy carbon black grade ELFTEX® TP (5 kg) at 70° C. with sulfanilic acid (310 g) in a batch pin pelletizer. The pelletizer was charged with the carbon black and sulfanilic acid and the motor speed was set to about 200 rpm. The pelletizer was heated to 70° C. Sodium nitrite (125 g) was dissolved in 1 L of water. The nitrite solution was added via a pressurized delivery system to the pelletizer. Likewise, 3 L of water were added. After all the water had been added, the batch was mixed for 3 minutes. Wet pellets of the carbon black product having attached $—C_6H_4SO_3^-Na^+$ groups were then collected. The pellets were found to contain 42% water by weight.

Examples 1–5

Samples of spinning solutions according to the present invention were tested to evaluate the stability of the spinning solutions as determined by pigment leaching into the fiber-forming bath often referred to as a coagulation bath.

Preparation of Spinning Dope

A polyacrylonitrile (PAN) copolymer containing 8–10% vinyl acetate and less than 1% sodium sulfonate comonomer units dissolved in dimethyl formamide (DMF) was prepared in a batch mixer consisting of a stainless steel vessel heated by electrical resistance heaters and fitted with an airtight cover and a mixing blade. The vessel was cylindrical with a hemispherical bottom and had a 4-liter capacity. The mixing blade fit the lower half of the vessel to within 1/16" of the vessel wall and had cross members to prevent stagnation.

The spinning dope was prepared three days before spinning. For the preparation of 24% PAN copolymer in DMF, 480.0 g of the copolymer and 2170 ml of DMF were used. The PAN was dissolved by heating the vessel with DMF to 220° F., adding the PAN copolymer in increments over 0.5 hr, and stirring slowly with a spatula. After all the copolymer was added, the temperature was raised to 250° F. and the slurry was continually stirred with mixing blades for an additional 0.5 hr. The heat was then turned off while mixing was continued for 2 hr during slow cooling of the dope. Prepared solution was let set for more than two days.

To prepare each batch of spinning solution with carbon black, mother liquors of carbon black in DMF were used having different concentrations of carbon black, but the final concentrations of carbon black in the acrylic fiber were kept constant at 2.0% by weight. A description of mother liquors and spinning solutions is presented in Table 3.

TABLE 3

| Sample | Type of Carbon Black | Concentration of Carbon Black in Mother Liquor (% by weight) | % By Weight Mother Liquor in Spinning Solution | % By Weight Dope in Spinning Solution |
|---|---|---|---|---|
| Example 1 | CB-3 | 6 | 7.60 | 92.40 |
| Example 2 | BLACK PEARLS ® 450 | 15 | 3.18 | 96.82 |
| Example 3 | CB-1 | 6 | 7.60 | 92.40 |
| Example 4 | CB-5 | 10 | 4.70 | 95.30 |

Each sample of mother liquor with carbon black was mixed with a spatula for 5 min and then added to the PAN solution to form 250 g of spinning dope. After 5 min of mixing, the blend was transferred into stainless steel dope pots (2-liter capacity) and was set for at least 0.5 hr to degas.

Spinning Process

For wet spinning a laboratory type extrusion apparatus was used. The spinning solution was transferred from the dope pot to a Zenith solution pump (capacity 0.16 cc/rev) under nitrogen pressure of 12–17 psi. Solution pressure was measured with a Tuffgage TM pressure probe positioned before the filter holder and the solution pressure measured 5–7 psi. The solution was pumped at a constant rate of 6 rpm through 80/400-mesh filter. After each sample run, the filters were removed for observation and taken for further analysis. The relatively short sample run time 0.5–1.0 hr did not evidence any difference in cleanliness of the filters during spinning.

Each filtered solution was maintained at about 70° C. and pumped to a spinneret holder horizontally positioned several inches under the surface of a coagulation bath. A 30-hole spinneret with a hole diameter of 0.05 mm was used for spinning. The fiber-forming bath contained 16 liters of 40% DMF in deionized water at 40° C. The temperature of the bath was maintained with the use of a steam generator at minimum output. For each day of spinning, a new spinning bath was prepared and used. Two samples were formed on the first day and four samples were formed on the second day. The decrease of DMF concentration in each spinning bath was compensated for by adding small amounts of DMF (20–100 ml) controlled by a refractometer (Fisher Scientific Co.). The refractive index was maintained as close as possible to the initial bath index of 1.3793. Extruded filaments were coagulated in the bath and then conveyed into a second, rinsing bath by a pair of canted rolls.

The second bath contained 5 liters of deionized water at room temperature. Formed and rinsed filaments were pulled through this bath at a speed of 23 feet per minute (fpm) on four pairs of rolls—5 wraps on the first two pairs of rolls, 2–4 wraps on third and fourth pairs of rolls. The pulled filaments were collected on a Leesona conical winder for more than 0.5 hr.

The spinning equipment was cleaned, purged with about 100 ml DMF and then purged with new sample material after each sample run. Collection of new sample began after 5–10 min of established stable spinning. Linear density checks of as-spun fiber after overnight drying at room temperature gave a value of 180 denier for Example 1.

No leaching of carbon black from the spinning solution into the fiber-forming bath was observed during 34 hrs of wet spinning. The color of the fiber-forming bath remained clear and transparent at all times during wet spinning.

All tested compositions were able to be processed relatively well and without difficulties.

Examples 6–8 and Comparative Example 1

Four different wet spinning solutions were prepared, Example 6–8 and Comparative Example 1. Each solution contained 0.7 part by weight polyacrylonitrile polymer, 6.3 parts by weight carbon black or modified carbon black, and 93 parts by weight dimethyl formamide (DMF). CB-2 was used in Example 6, CB-3 was used in Example 7, and CB-4 was used in Example 8. For Comparative Example 1, the wet spinning solution contained untreated carbon black (CB-1) having the same surface area and absorption values as the modified carbon black used in Examples 6–8.

For each of Examples 6–8 and Comparative Example 1, the wet spinning solution was formed into a dispersion by mixing. The mixing equipment used to mechanically disperse carbon black or modified carbon black in each solution included a Szegvari attritor system of the type 01 AIR, size 01, nos. 920805 and 920806, available from Union Process of Akron, Ohio. The attritor system used an SS ball media consisting of 1,800 grams of ⅛" SS shot. The attritor was run at a speed of 450 rpm and mixing was conducted at room temperature in water-cooled 1.5 liter reaction vessels. Mixing lasted for 15 minutes and the total amount of wet spinning solution mixed in each vessel was 300 milliliters (ml), and contained 283.2 grams DMF, 19.8 grains of carbon black or modified carbon black, and 2.13 grams of PAN polymer for each solution.

After mixing, each solution was evaluated based on dispersibility. The results of the dispersibility evaluation are shown below in Table 4.

A sample of each solution was put on a respective glass slide and spread with the edge of another glass slide. Each spread sample was allowed to air-dry on the glass slide. Optical microscope image analysis was then performed for each dried sample using a 100× microscope. The percentage of the area observed and analyzed which was occupied by carbon black particles of over 5 microns in size was determined and expressed as undispersed area percent. The results of the Kontron image analysis are also shown in Table 4 below.

Four other samples of Examples 6–8 and Comparative Example 1 were each letdown in DMF to a three percent concentration then examined with 100× optical microscopy. The amount and size of undispersed particles in each sample was evaluated and the results are shown in Table 4 below.

TABLE 4

| Sample | Carbon Black Treatment | Carbon Black Incorporation | Kontron Undispersed Area (%) | Average Particle Diameter of Undispersed Particles (microns) | Undispersed Particle Size (microns ave. diam.) After 3% Letdown |
|---|---|---|---|---|---|
| Comparative Example 1 | CB-1 (no treatment) | carbon black falls out to the bottom of solution | not applicable | not applicable | many particles of several hundred $\mu$m |
| Example 6 | CB-2 | good incorporation | 20.0 | 31.5 | a few particles of less than 20 $\mu$m |
| Example 7 | CB-3 | good incorporation | 1.275 | 6.7 | a few particles of less than 20 $\mu$m |
| Example 8 | CB-4 | good incorporation | 3.51 | 8.4 | a few particles of less than 20 $\mu$m |

Figure 2:
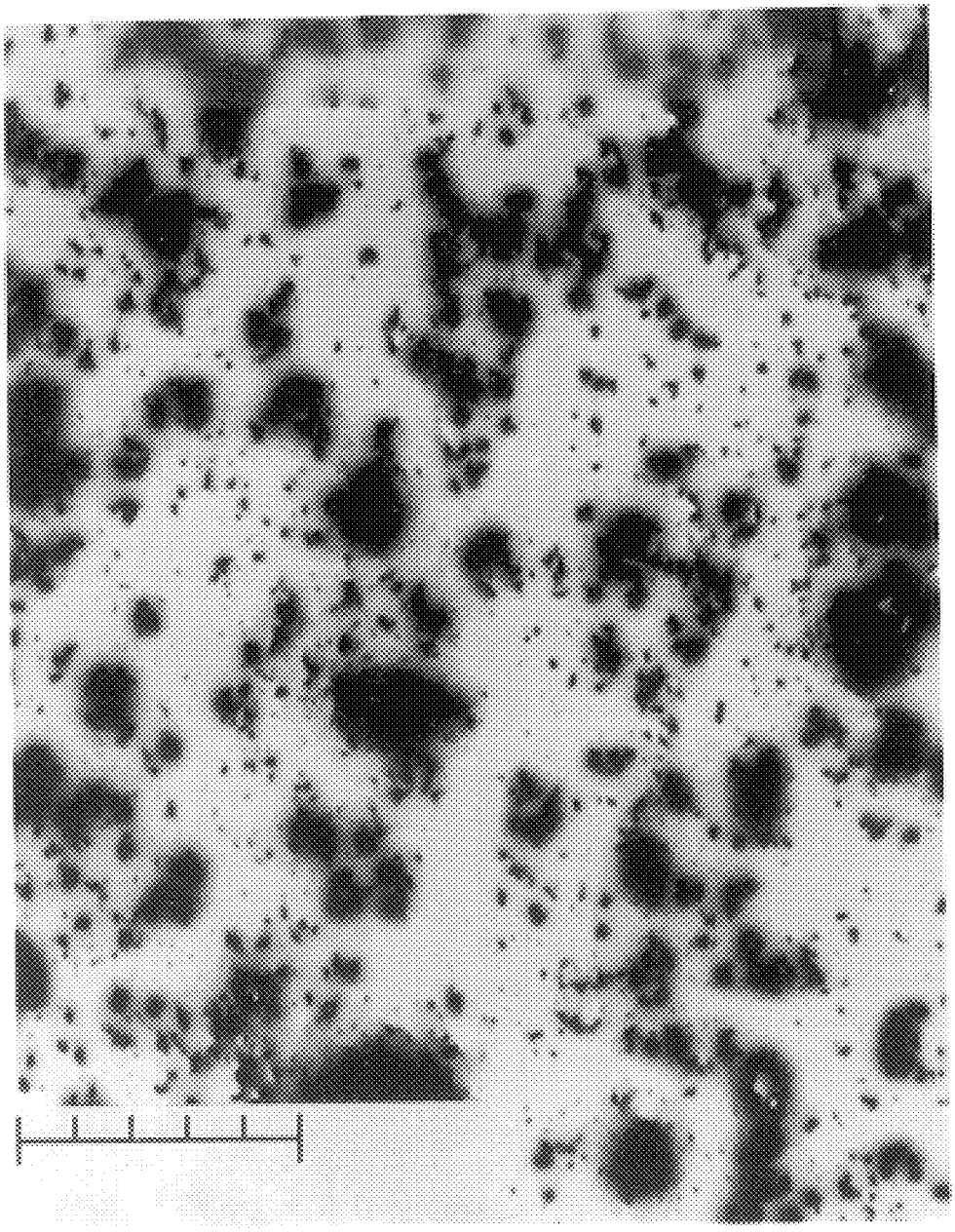
FIGS. 2–4 are photomicrographs of spinning solutions according to the present invention, comprising various types of a modified carbon black, which are highly dispersed throughout the solution.
Figure 3:
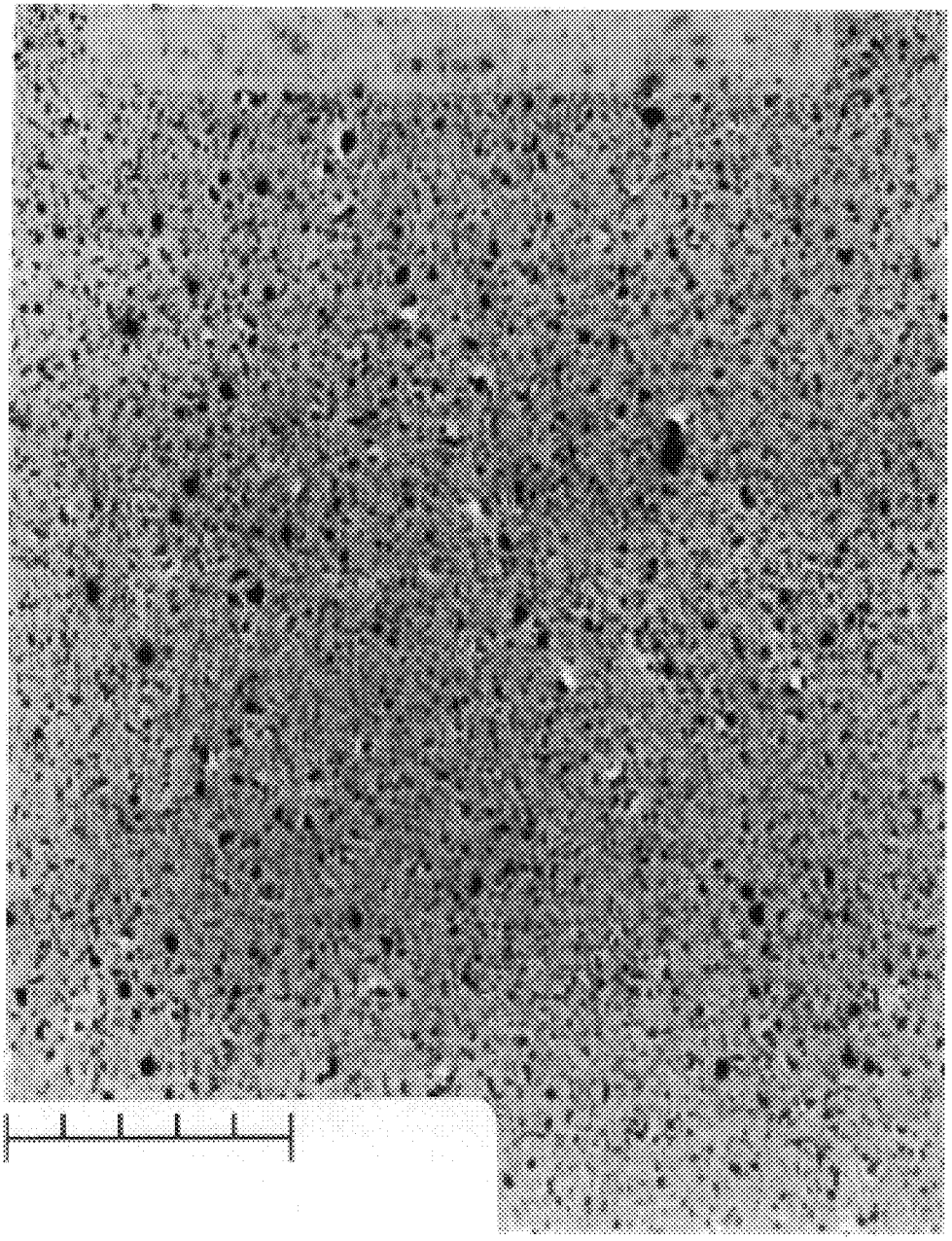
Figure 4:
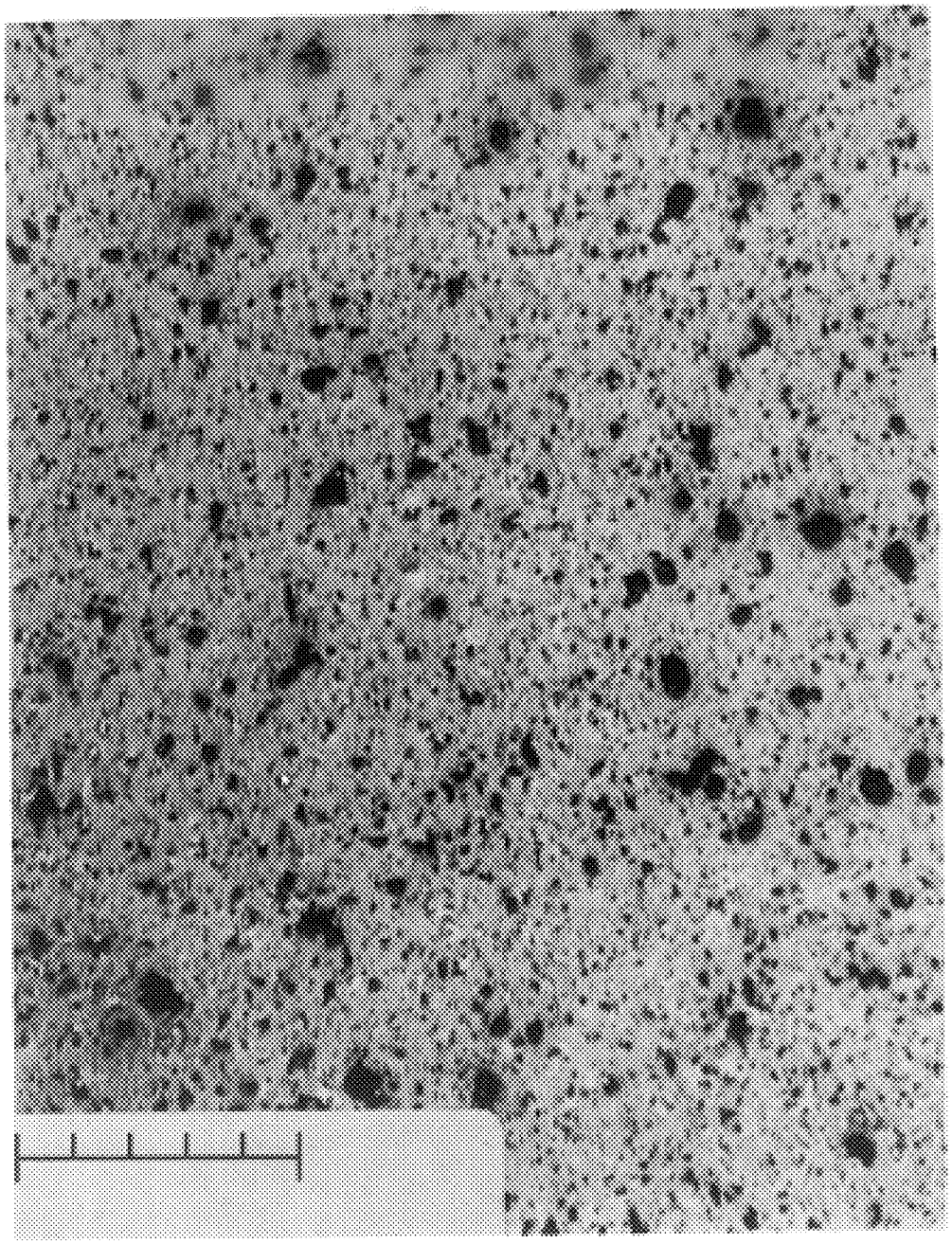

In view of the comparison between the treated carbon blacks of Examples 6–8 and the untreated but otherwise identical carbon black of Comparative Example 1, it is clear from Table 4 that the treated carbon blacks are better dispersed in a polyacrylonitrile polymer wet spinning solution compared to the dispersibility of untreated carbon black. This conclusion is confirmed by the photomicrographs of the dispersions shown in FIGS. 1–4, wherein FIG. 1 is a photomicrograph of Comparative Example 1 and FIGS. 2–4 are photomicrographs of Examples 6–8, respectively.

Other embodiments of the present invention will be apparent to those skilled in the art from consideration of the specification and practice of the present invention disclosed herein. It is intended that the specification and examples be considered as exemplary only, with a true scope of the present invention being indicated by the following claims.

What is claimed is:

1. A wet-spun acrylic-containing polymer fiber comprising a modified pigment having attached at least one organic group and being substantially dispersed throughout a polymer comprising an acrylic structural unit.

2. The fiber of claim 1, wherein said modified pigment is a modified carbon black, and said organic group comprises a sodium sulfoplhenyl group which is present at a treatment level of from about 0.1 to about 6.0 $\mu m/m^2$ pigment.

3. The fiber of claim 1, wherein said organic group comprises a) at least one aromatic group or a $C_1$–$C_{12}$ alkyl group, and b) at least one ionic group, at least one ionizable group, or a mixture of an ionic group and an ionizable group.

4. The fiber of claim 1, wherein said organic group comprises at least one ionic group, at least one ionizable group or a mixture thereof.

5. The fiber of claim 1, wherein said modified pigment is a modified carbon black.

6. An article comprising the fiber of claim 5.

7. A reinforcing material comprising the fiber of claim 5.

8. The fiber of claim 1, wherein said modified pigment is a modified carbon black having a surface area of at least about 150 $m^2/g$.

9. The fiber of claim 1, wherein said organic group is a sodium sulfophenyl group.

10. The fiber of claim 1, wherein said organic group is a sodium carboxyphenyl group.

11. The fiber of claim 1, wherein said organic group is present at a treatment level of from about 0.1 to about 6.0 $\mu mol/m^2$pigment.

12. The fiber of claim 1, wherein said polymer further comprises nitrile structural units.

13. The fiber of claim 1, wherein said polymer comprises a polyacrylic homopolymer.

14. The fiber of claim 1, wherein said polymer comprises a polyacrylonitrile copolymer.

15. An article comprising the fiber of claim 1.

16. The article of claim 15, wherein said article is clothing.

17. The article of claim 15, wherein said article is a blanket, rug, upholstery, pile, luggage, awning, and/or furniture.

18. A reinforcing material comprising the fiber of claim 1.

19. The polymeric fiber of claim 1, wherein said organic group comprises a) an aromatic group or a $C_1$–$C_{12}$ alkyl group and b) an ionic or ionizable group, wherein the organic group has the formula: —AG—Sp—LG—Z, wherein AG is an activating group, LG is a leaving group, Sp is a spacer group that assists the activating group to promote elimination of the leaving group LG, and Z is a counterion.

20. The fiber of claim 1, having been formed by a process comprising forming a solution comprising said polymer, said modified pigment, and a solvent, wherein said modified pigment and said solvent have polarities which are substantially the same such that the modified pigment is dispersed throughout the solution and the polymer is substantially dissolved in the solvent, and spinning the solution to form said fiber.

21. The fiber of claim 20, wherein forming the spinning solution comprises polymerizing reactive monomeric acrylic units in the solvent to form said polymer in situ.

22. A wet-spun polymeric fiber comprising a modified pigment having attached at least one organic group and being substantially dispersed throughout a polymer.

23. The polymeric fiber of claim 22, wherein said polymer comprises cellulose.

24. The polymeric fiber of claim 22, wherein said polymer is a rayon.

25. The polymeric fiber of claim 22, wherein said polymer comprises a long-chain synthetic polyamide.

26. The polymeric fiber of claim 25, wherein said long-chain synthetic polyamide has at least 85% of the amide linkages attached directly between two aromatic rings.

27. The polymeric fiber of claim 22, wherein said polymer comprises a long-chain synthetic polymer containing at least 85% of a segmented polyurethane.

28. The polymeric fiber of claim 22, wherein said polymer comprises cellulose acetate.

29. The polymeric of claim 22, wherein said polymer comprises a long-chain aromatic polymer having recurring imidazole groups as part of the polymer chain.

30. The polymeric fiber of claim 22, wherein said polymer is polybenzimidazole.

31. The polymeric fiber of claim 22, wherein said polymer comprises a long-chain synthetic polymer comprising vinyl chloride units.

32. The polymeric fiber of claim 22, wherein said modified pigment is a modified carbon black, and said organic group comprises a sodium sulfophenyl group.

33. The polymeric fiber of claim 22, wherein said organic group comprises a) at least one aromatic group or a $C_1$–$C_{12}$ alkyl group, and b) at least one ionic group, at least one ionizable group, or a mixture of an ionic group and an ionizable group.

34. The polymeric fiber of claim 22, wherein said organic group comprises at least one ionic group, at least one ionizable group or a mixture thereof.

35. The polymeric fiber of claim 22, wherein said modified pigment is a modified carbon black.

36. The polymeric fiber of claim 22, wherein said organic group is present at a treatment level of from about 0.1 to about 6.0 $\mu$mol/m$^2$ pigment.

37. An article comprising the polymeric fiber of claim 22.

38. The article of claim 37, wherein said article is clothing.

39. The article of claim 37, wherein said article is a blanket, rug, upholstery, pile, luggage, awning, furniture, a woven good, a non-woven good, a diaper component, and/or a feminine care product.

40. A reinforcing material comprising the fiber of claim 22.

41. The polymeric fiber of claim 22, wherein said organic group comprises a) an aromatic group or a $C_1$–$C_{12}$ alkyl group and b) an ionic or ionizable group, wherein the organic group has the formula: —AG—Sp—LG—Z, wherein AG is an activating group, LG is a leaving group, Sp is a spacer group that assists the activating group to promote elimination of the leaving group LG, and Z is a counterion.

* * * * *